United States Patent [19]

Maxwell

[11] Patent Number: 4,624,060

[45] Date of Patent: Nov. 25, 1986

[54] SYSTEM FOR ATTACHING MATED PAIRS OF SHOES TOGETHER

[76] Inventor: Susan M. Maxwell, 3640 Independence Ave. South, Apt. 50, St. Louis Park, Minn. 55426

[21] Appl. No.: 731,762

[22] Filed: May 8, 1985

Related U.S. Application Data

[63] Continuation of Ser. No. 539,663, Oct. 6, 1983, abandoned.

[51] Int. Cl.[4] ..... A43C 11/00

[52] U.S. Cl. ..... 36/1; 36/58.5; 24/117; 24/119

[58] Field of Search ..... 24/117 R, 118, 119, 24/120, 442; 36/1, 50, 58.5

[56] References Cited

U.S. PATENT DOCUMENTS

| | | | |
|---|---|---|---|
| 509,529 | 11/1893 | Harris . | |
| 671,711 | 4/1901 | Soderberg | 24/117 R |
| 794,561 | 7/1905 | Spencer . | |
| 897,476 | 9/1908 | Milliken . | |
| 948,338 | 2/1910 | McMaster | 24/117 R |
| 949,201 | 2/1910 | Shaw . | |
| 1,189,989 | 7/1916 | Moore | 36/1 |
| 1,300,998 | 4/1919 | Nelson | 36/1 |
| 1,470,280 | 10/1923 | McCulloch . | |
| 3,041,743 | 7/1962 | Monsma | 36/1 |
| 3,208,164 | 9/1965 | Hoyt, Jr. | 24/117 R |
| 3,399,329 | 8/1968 | Zimmon | 36/1 |
| 3,464,125 | 9/1969 | Conway | 36/58.5 |
| 3,482,335 | 12/1969 | Ornsteen | 36/1 |
| 4,112,551 | 9/1978 | Sales | 24/117 R |
| 4,254,566 | 3/1981 | Haskell . | |

*Primary Examiner*—Victor N. Sakran

*Attorney, Agent, or Firm*—Merchant, Gould, Smith, Edell, Welter & Schmidt

[57] ABSTRACT

A system for connecting mated pairs of shoes to prevent separation and possible mismatching when offered for sale in self-service stores. According to the system, the shoes at the time of manufacture are provided with a fastening tab inside the shoe. The tab comprises a length of narrow strong sheet material having a hole or loop at one end for receiving a fastening filament. The fastening tab is folded and disposed with one portion having the hole or loop at its end extending vertically up from the sole along the inside wall of the inner portion of the shoe but not attached to the shoe wall. The other portion of the fastener tab is secured by means of strong adhesive, stitching, staples, or all three, to the bottom sole of the shoe and the inner sole applied on top of the adhered portion of the fastening tab. The shoes are fastened together by passing a filamentary connector, preferably a locking plastic fastener, through the hole or loop in each of the fastening tabs and through the price tag before joining the ends together in a closed loop.

4 Claims, 3 Drawing Figures

SYSTEM FOR ATTACHING MATED PAIRS OF SHOES TOGETHER

This is a continuation of application Ser. No. 539,663, filed Oct. 6, 1983, now abandoned.

BACKGROUND OF THE INVENTION

1. Field of the Invention

This invention relates to a system for attaching together mated pairs of shoes offered for sale. In the mass merchandising of relatively inexpensive shoes by self-service department stores, discount stores, factory outlets, and the like, it is common practice to fasten the mated shoes of a pair together, to prevent their separation and possible mismatching. The price tag is usually attached at the same time. This is customarily done by means of a thin strong plastic filament about 8 or 10 inches long having locking means for joining the ends together. In the case of shoes having straps or buckles or eyelets for shoe laces or vents or the like, there is no problem in fastening the shoes together because the locking filament may easily be inserted through one of the available apertures on each of the shoes. The filament is passed through a hole in the price tag and the ends are locked together. Some shoes, however, do not have any available aperture. It has been the practice to pierce the side of the shoe in order to thread the connecting filament through it. This leaves an undesirable and unsightly blemish after the filament is cut and removed, after purchase of the shoes.

2. The Prior Art

McCulloch U.S. Pat. No. 1,470,280, Milliken U.S. Pat. No. 897,476 and Spencer U.S. Pat. No. 794,561 are exemplary of the prior art relating to attaching mated shoes of a pair together, primarily for convenience and identification purposes. Harris U.S. Pat. No. 509,529, Shaw U.S. Pat. No. 949,201 and Haskell U.S. Pat. No. 4,254,566 are exemplary of the prior art relating to atachment of price tags to shoes. None of the prior art addresses the problem of connecting together mated shoes of a pair which do not have any vent or eyelet or buckle or other aperture through which a connecting filament may be passed.

SUMMARY OF THE INVENTION

Broadly stated, the system according to the present invention for attaching together mated pairs of shoes comprises in combination a pair of shoes, each of which has a fastening tab firmly secured thereto and with a hole at one end or with a loop formed by the doubling of the tab, and a filamentary fastening element extending through the holes or loops of each of the fastening tabs, the ends of the filamentary element being joined together in a closed loop. Each fastening tab is formed from elongated narrow strong sheet material, such as synthetic resinous plastic material and each fastening tab has two parts. The first of these parts comprising one end of the elongated tab extends horizontally between the inside surfaces of the outer and inner soles of each shoe and is firmly secured thereto. The second of the tab parts comprising the opposite end of the elongated tab extends around the edge of the inner sole of the shoe and vertically upwardly along the inside surface of the upper body of the shoe, but spaced therefrom. The connecting filamentary element can readily be threaded through the holes at the ends of the vertically extending tabs or through the loops caused by doubling the tabs, threaded through a price tag if desired, and fastened together in a closed loop.

BRIEF DESCRIPTION OF THE DRAWINGS

The invention is illustrated in the accompanying drawings in which corresponding parts are identified by the same numerals and in which.

BRIEF DESCRIPTION OF THE PREFERRED EMBODIMENT

Figure 1:
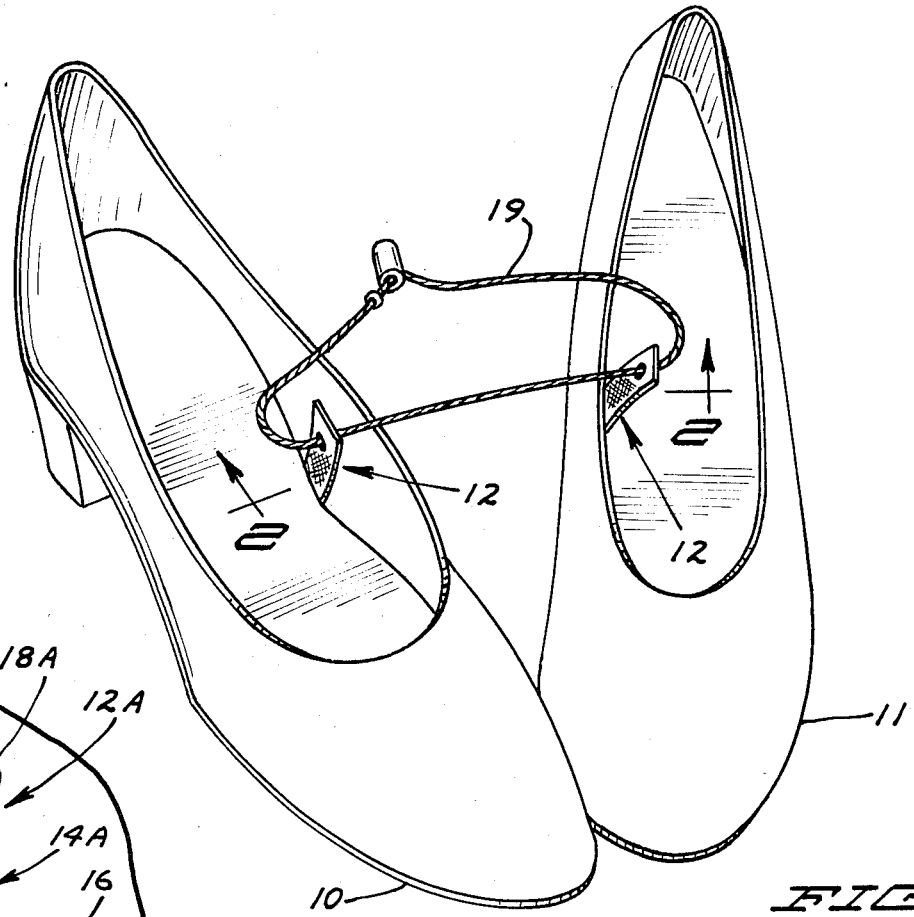
FIG. 1 is a perspective view of a pair of ladies' pumps fitted with fastening tabs and secured together according to the present invention.
Figure 3:
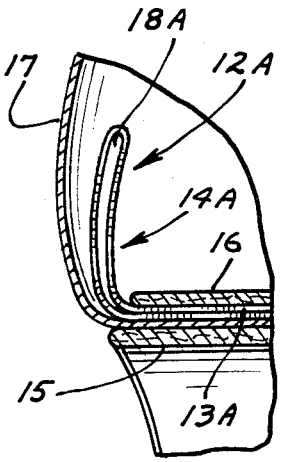
FIG. 3 is a similar fragmentary vertical section showing an alternative form of fastening tab.
Figure 2:
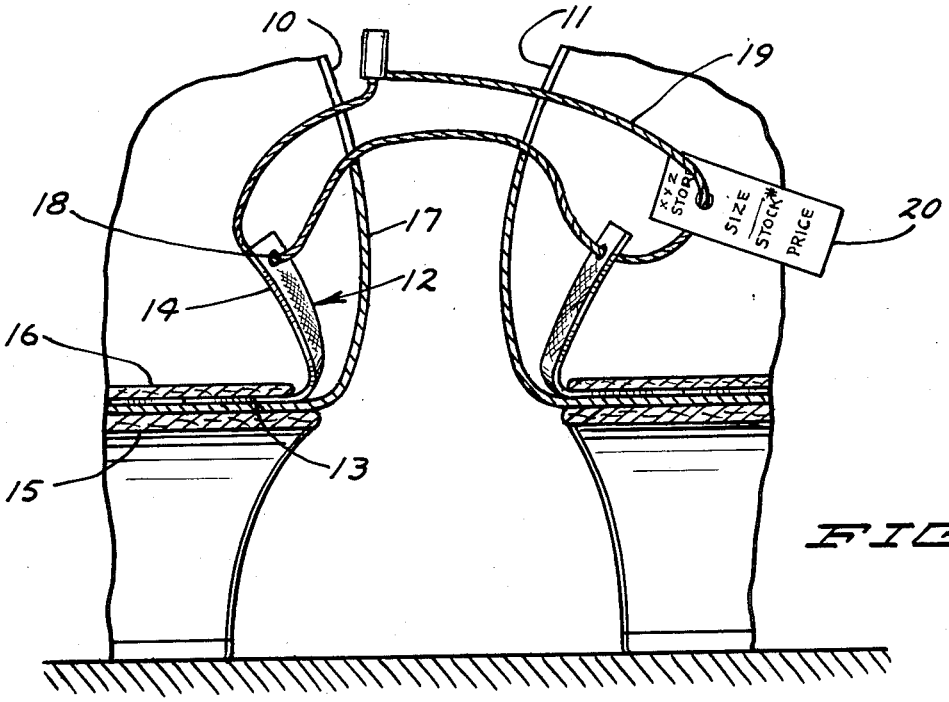
FIG. 2 is a vertical section on the line 2—2 of FIG. 1 and in the direction of the arrows.

Referring now to the drawings, there is shown a pair of shoes 10 and 11 in the form of ladies' pumps intended to be worn on the right foot and left foot, respectively. At the time of manufacture, each shoe is provided with a fastening tab indicated generally at 12. Tab 12 is thin flat and elongated formed from strong sheet material, such as plastic impregnated cloth, polyester film such as Mylar, or similar strong material which is resistant to tearing.

The fastening tab 12 is composed of two parts 13 and 14 representing opposite ends of the tab. Tab portion 13 is hidden from view lying between the inside surface of the shoe outer sole 15 and the shoe inner sole 16 and firmly secured thereto, as by means of adhesive, stitching or staples, or some combination of these. The visible portion 14 of the fastening tab extends around the edge of inner sole 16 and generally vertically upwardly along the inside surface of the shoe upper wall 17, but spaced therefrom. Preferably, as shown, the fastening tabs are secured adjacent to the inner portions of both shoes which are adjacent when the shoes are displayed in their normal right-left relationship. The tabs are also preferably located approximately midway between the toe and heel portions of the shoes. Alternatively, the tabs may be stitched into a lining seam of the shoes at the sides or back of the shoes.

Each tab portion 14 has an aperture through which a fastener may be passed. This may be in the form of a hole 18 through the tab. Alternatively the tab 12A is folded over on itself to form a loop 18A in the tab portion 14A. A filamentary fastener 19 may be threaded through the hole 18 of each tab or through the loop 18A formed, and preferably also through a size/stock/price tag 20. The ends of the filamentary connector are then joined together in a closed loop.

The connector 19 illustrated is typical of several locking plastic fasteners which are commercially available. These are preferred because of their locking feature because the shoes cannot be accidentally separated. Although differing in details, such fasteners comprise a strong filament having a cage or loop at one end through which a barbed or knobbed portion of the opposite end may be drawn in one direction only. Thereafter, the shoes may be separated only by cutting the filament. However, obviously non-locking connecting filaments in the form of string or cord or wire or tape, or the like, may optionally be used.

If the customer who purchases the shoes finds the free ends 14 of the tabs 12 to be objectionable, they may simply be snipped off with a scissors, having served their function once the shoes are purchased.

The expressions "horizontal" and "vertical" as used herein are with reference to the shoes as might be displayed on a horizontal table or shelf, or as worn when standing.

Although size is not critical in any sense, typically the fastening tab may be between about $\frac{1}{4}$ to $\frac{3}{4}$ inch in width and $1\frac{1}{2}$ to 3 inches in length with the hole 18 spaced inwardly about $\frac{1}{8}$ to $\frac{1}{4}$ inch from the end. Approximately one-half of the length of the tab should be secured between the inner and outer soles. Although shown as rectangular, the tab may obviously have rounded ends or may be in the form of an elongated oval, or the like.

It is apparent that many modifications and variations of this invention as hereinbefore set forth may be made without departing from the spirit and scope thereof. The specific embodiments described are given by way of example only and the invention is limited only by the terms of the appended claims.

The embodiments of the invention in which an exclusive property or privilege is claimed are defined as follows:

1. A system for attaching together mated pairs of shoes, which comprises in combination:

(A) a pair of shoes, each of which has an inner sole and an outer sole, each shoe also having a shoe upper with an inside surface and a top edge, each of said shoes further having a fastening tab and means for securing said tab between said inner and outer soles, (1) said fastening tab being an integral sheet with two parts, (2) the first of said parts comprising one end of the elongated tab extending horizontally between the inside surfaces of the outer sole and inner sole of the shoe and firmly secured thereto with said securing means, (3) the second of said parts comprising the opposite end of the elongated tab extending from one edge of the inner sole and vertically upward along but spaced from the inside surface of the shoe upper and extending so that said opposite end remains beneath the top edge of said shoe upper, (4) the second of said parts having an aperture in the form of a loop formed by doubling the fastening tab over on itself, and (B) a filamentary fastening element extending through the apertures of each of said fastening tabs, the ends of the filamentary element being joined together in a closed loop;

whereby said pair of shoes is attached together by said fastening element passing through the aperture in each of said tabs so that on removal of said fastening element, said shoes separate and said tabs are not visible outside said shoe uppers.

2. A system according to claim 1 wherein said filamentary fastening element is a locking plastic fastener of the type in which one barbed end of the filament is captured and retained in a loop or cage at the opposite end.

3. A system for attaching together mated pairs of shoes, which comprises in combination:

(A) A pair of shoes, each of which has an inner sole and an outer sole, said inner sole having a side edge, each shoe also having a shoe upper with an inside surface and a top edge, each of said shoes further having a fastening tab and means for securing said tab between said inner and outer soles, (1) said fastening tab being an integral sheet with two parts, (2) the first of said parts extending horizontally between the outer sole and the inner sole of the shoe and being firmly secured thereto with said securing means, (3) the second of said parts comprising the opposite end of the tab extending from the first of said parts at the side edge of the inner sole upwardly along the inside surface of the shoe upper and extending so that said opposite end remains beneath the top edge of said shoe upper, (4) the second of said parts having an aperture adjacent to its outermost end, and (B) a fastening element extending through the apertures of each of said fastening tabs, the ends of the element being joined together in a closed loop;

whereby said pair of shoes is attached together by said fastening element passing through the aperture in each of said tabs so that on removal of said fastening element, said shoes separate and said tabs are not visible outside said shoe uppers.

4. A system according to claim 3 wherein said aperture is a hole in the fastening tab.

* * * * *